United States Patent [19]

Ogata et al.

[11] Patent Number: 4,510,415

[45] **Date of Patent: * Apr. 9, 1985**

[54] FLUORESCENT LAMP AND PROCESS FOR FABRICATING THE SAME

[75] Inventors: Yoshiro Ogata, Osaka; Haruo Yamazaki, Shiga; Hidezoh Akutsu, Hyogo, all of Japan

[73] Assignee: Matsushita Electronics Corporation, Osaka, Japan

[ * ] Notice: The portion of the term of this patent subsequent to Dec. 27, 2000 has been disclaimed.

[21] Appl. No.: 539,671

[22] Filed: Oct. 6, 1983

Related U.S. Application Data

[63] Continuation of Ser. No. 263,575, May 14, 1981, Pat. No. 4,423,350.

[30] Foreign Application Priority Data

May 14, 1980 [JP] Japan ..... 55-64510

[51] Int. Cl.[3] ..... H01J 63/04; H01J 9/00

[52] U.S. Cl. ..... 313/493; 313/573; 313/612; 445/26

[58] Field of Search ..... 313/573, 634, 609–612, 313/493; 220/2.1 R; 445/26

[56] References Cited

U.S. PATENT DOCUMENTS 1,961,897 6/1934 Bol ..... 313/634

*Primary Examiner*—Palmer Demeo
*Assistant Examiner*—Sandra L. O'Shea
*Attorney, Agent, or Firm*—Burgess, Ryan & Wayne

[57] ABSTRACT

In a fluorescent lamp of the type in which a lamp envelope comprises an outer bulb having generally a spherical or a partially spherical or a cylindrical configuration and an inner bulb inserted into the outer bulb in predetermined nested relationship; either of the inner surface of the outer bulb or the outer surface of the inner bulb is formed with a groove which defines a zig-zag discharge path between the outer and inner bulbs; a phosphor is formed at least over the wall surfaces of the groove; electrodes are disposed at the ends, respectively, of the discharge path and a uv (ultraviolet) radiation-emitting discharge gas consisting of mercury vapor and a rare gas or a rare gas mixture is filled in the discharge path, both the open end portions of the outer and inner bulbs are flared radially outwardly and inwardly respectively, or either of the open end portion of the outer or inner bulb is flared radially outwardly or inwardly so that glass frit can be filled into the annular space defined between the open end portions of the outer and inner bulbs both or either of which is flared. When glass frit is heated and then solidified, not only the open ends of the outer and inner bulbs can be gas-tightly sealed together but also lead-wires which also support the electrodes at the ends of the discharge path are also gas-tightly sealed.

2 Claims, 5 Drawing Figures

FLUORESCENT LAMP AND PROCESS FOR FABRICATING THE SAME

This is a continuation of application Ser. No. 263,575, filed May 14, 1981 now U.S. Pat. No. 4,423,350.

BACKGROUND OF THE INVENTION

The present invention relates to a fluorescent lamp and a process for fabricating the same.

At present, incandescent and fluorescent lamps are widely used for indoor lighting. Although the incandescent lamps have a low efficiency of the order of about 15 lm/W (in the case of 100 W) which is considerably lower than the efficiency of the fluorescent lamps, they are as much used as the fluorescent lamps. The reason is that since the incandescent lamps are simple to operate and compact in size yet capable of highly luminous light, they can readily provide the so-called accentuation lighting. Therefore, they are widely used in homes and shops. However, from the standpoint of energy saving, apparently it is not preferable to use the incandescent lamps with low efficiencies. As a result, there has been a strong demand for electric discharge lamps which have all the advantages of the incandescent lamps and further have a high efficiency.

In an attempt to meet such demand, the same inventors proposed a fluorescent lamp as disclosed in U.S. Pat. No. 4,095,135 (British Pat. No. 1,578,246). This fluorescent lamp not only exhibits a high efficiency but also has all the merits of the incandescent lamps such as compactness. Briefly stated, the fluorescent lamp has generally a spherical or dome-shaped configuration and comprises a spherical or dome-shaped outer bulb and an inner bulb formed with a zig-zag groove over the outer wall surface thereof and inserted into the outer bulb in predetermined nested relationship so as to define a zig-zag discharge path therebetween. The discharge path has a substantially circular or elliptical cross sectional configuration and is filled with a uv radiation-emitting discharge gas consisting of mercury vapor and a rare gas or a rare gas mixture for producing ultraviolet radiation. A phosphor is applied to the inner wall surface of the outer bulb and/or the outer wall surface of the inner bulb.

However, the inventors found out that the step for sealing the open ends of the outer and inner bulbs together had some problems, adversely affecting the productivity of the production line. That is, as compared with the conventional tubular fluorescent lamps, the open ends of the outer and inner bulbs or the fluorescent lamp of the type described are very large in diameter. In addition, when these open ends are sealed, the lead-wires of the electrodes must be also sealed. The inventors conducted many tests for sealing the open ends together by the conventional sealing techniques used in the production of the conventional fluorescent lamps; that is, by melting the open ends and joining them together gas-tightly. The results are that cracks tend to propagate at the sealed portions and that leakages also tend to occur very often at the sealed portions and along the lead-wires connected to the electrodes disposed at the ends of the zig-zag discharge path.

SUMMARY OF THE INVENTION

In view of the above, one of the objects of the present invention is to provide a fluorescent lamp in which cracking of and leakages through the sealed portion can be completely eliminated.

Another object of the present invention is to provide a process for fabricating the fluorescent lamps of the type described which can eliminate defects of the sealed portions and consequently which is adapted for mass-production.

Briefly stated, according to the present invention, a fluorescent lamp has a lamp envelope comprising an outer bulb having generally a spherical or a partially spherical or a cylindrical configuration and an inner bulb with a zig-zag groove formed over the outer wall surface thereof so that when the inner bulb is inserted into the outer bulb in predetermined nested relationship, a zig-zag discharge path is defined between them. A radiation-emitting discharge gas is filled in the zig-zag discharge path and electrodes are disposed at the ends, respectively, thereof. Both the open end portions of the outer and inner bulbs are flared radially outwardly and inwardly, respectively. Alternatively, the open end portion of either the outer or inner bulb only is flared. Glass frit is filled into the annular space defined between the open end portions both or either of which is flared. When glass is heated and solidified, not only the open end portions of the outer and inner bulbs can be gas-tightly sealed together but also the lead-wires which also serve to support the electrodes at the ends of the discharge path can be also gas-tightly sealed.

The above and other objects, effects and features of the present invention will become more apparent from the following description of preferred embodiments thereof taken in conjunction with the accompanying drawings.

BRIEF DESCRIPTION OF THE DRAWINGS

Same reference numerals are used to designate similar parts throughout the figures.

DETAILED DESCRIPTION OF THE PRIOR ART

Figure 1A:
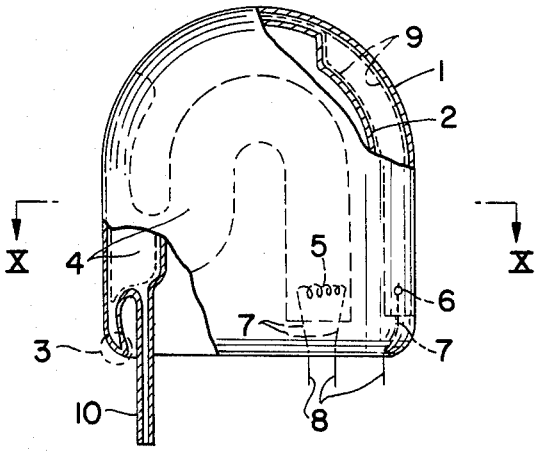
FIG. 1A PRIOR ART
FIG. 1A is a front view, partly broken and partly in section, of a prior art fluorescent lamp.
Figure 1B:
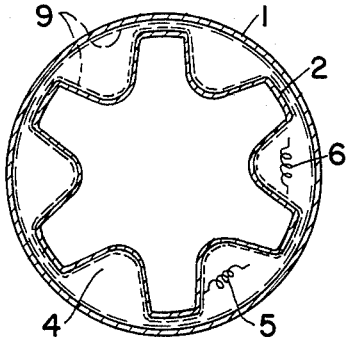
FIG. 1B PRIOR ART
FIG. 1B is a sectional view thereof taken along the line X—X of FIG. 1A.

In FIG. 1 is shown a fluorescent lamp disclosed in the above-mentioned U.S. Pat. No. 4,095,135. An outer bulb 1 is in the form of a partial sphere, a complete sphere or a cylinder and is made of a transparent glass. An inner bulb 2 which is made of the same material as the outer bulb 1 is inserted into the outer bulb 1. The open ends of the outer and inner bulbs 1 and 2 are hermetically joined or sealed at 3. The outer surface of the inner bulb 2 is formed with a continuous zig-zag groove 4 so that when the inner bulb 2 is fitted into the outer bulb 1, a zig-zag discharge path is defined between the outer surface of the inner bulb 2 and the inner surface of the outer bulb 1. Electrodes 5 and 6 are disposed at the ends, respectively, of the zig-zag discharge path and each of them is supported by a pair of lead-wires 7 which in turn are connected to exterior lead-wires 8. The inner surface of the outer bulb 1 and the outer surface of the inner bulb 2 are coated with a phosphor 9. The zig-zag discharge path is evacuated through an exhaust tube 10 and then an excess amount of mercury and a rare gas such as neon, argon, krypton or xenon is charged through the tube 10 into the zig-zag discharge path and is sealed.

The inventors found out that the step for sealing the open ends 3 of the outer and inner bulbs 1 and 2 presents some problems in the process for producing the fluorescent lamps of the type described. That is, the diameters of the open ends of the outer and inner bulbs 1 and 2 are by far greater than those at the ends of the conventional tubular fluorescent lamps. In addition, when the ends 3 are sealed; that is, when the ends of the zig-zag discharge path are sealed, the electrodes 5 and 6 and their supporting lead-wires 7 must be sealed concurrently. The same inventors conducted extensive tests of softening the ends 3 and the sealing member and then joining them to seal off the zig-zag discharge path and found out that cracks tend to propagate over the sealed portions and gas leakages tend to occur at the sealed portions and along the lead-wires 7 due to incomplete sealing.

DESCRIPTION OF THE PREFERRED EMBODIMENT

After extensive studies on the experimental results, the inventors found out that when the open ends of the outer and inner bulbs are imparted with suitable shapes and when glass frit is used, the open ends can be sealed in a highly reliable and dependable manner and consequently the mass production of the fluorescent lamps can be much facilitated as will be described in detail below.

Figure 2:
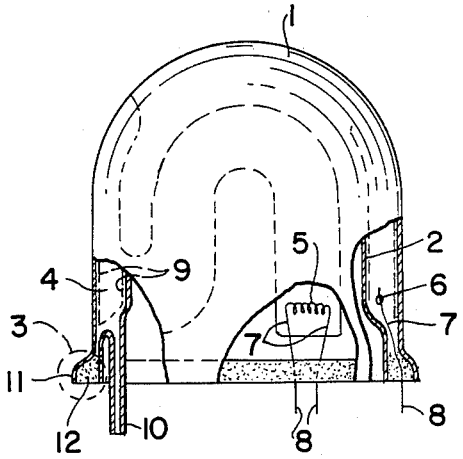
FIGS. 2, 3 and 4 show a first, a second and a third embodiment, respectively, of the present invention.

In FIG. 2 is shown a first embodiment of the present invention. The open end portion of the outer bulb 1 is flared to provide an annular flared conical portion 11 which is adapted to receive glass frit 12. Since the open end of the outer bulb 1 is flared, glass frit 12 can be uniformly placed in the flared end portion in amount sufficient to seal the zig-zag discharge path. When glass frit is heated and melted, it flows into the narrow space between the outer and inner bulbs 1 and 2 by capillary action so that leakages can be substantially eliminated. In addition, glass frit 12 serves to securely support the lead-wires 7 which in turn support the electrode 5 or 6 before the open ends of the outer and inner bulbs 1 and 2 are sealed together. When glass frit 12 is vitrified, the lead-wires 7 are completely sealed so that leakages along them can be completely avoided.

It is very important that the outer and inner bulbs 1 and 2 and glass frit 12 have substantially the same coefficient of thermal expansion, but the present invention needs no specially prepared glass material and can use commercially available glass material. That is, the outer and inner bulbs 1 and 2 can be made of soda-lime glass or lead glass. Glass frit 12 may be amorphous or crystal and have a vitrification point of 320° to 350° C. With these glass materials, very satisfactory results can be obtained.

The lead-wires 7 may be made of Dumet or stainless steel which is widely used in the conventional fluorescent lamps. However, when the diameter of the lead-wires 7 exceeds about 0.4 mm, it is preferable to form grooves on the inner surface of the outer bulb 1 or the outer surface of the inner bulb 2 so as to receive therein the lead-wires 7. Then, the spacing between the outer and inner bulbs 1 and 2 can be maintained narrow so that very satisfactory sealing effects can be attained. Similar effects can be also attained by sealing the lead-wires 7 with glass or supporting them with a glass bead.

Figure 3:
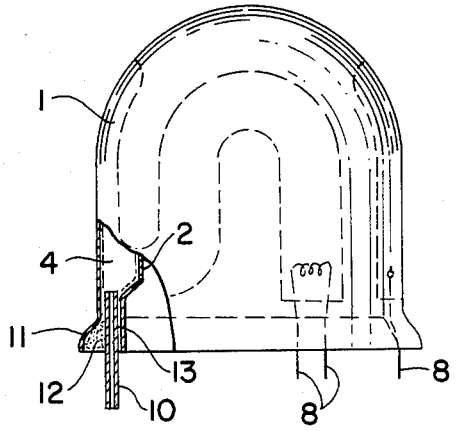

As shown in FIG. 3, a groove 13 may be formed on the outer surface of the inner bulb 2 so as to receive therein the exhaust tube 10. Therefore, the exhaust tube 10 is also sealed when the ends 3 of the outer and inner bulbs 1 and 2 are sealed together with the lead-wires 7 with glass frit 12. With this arrangement, the step for welding or otherwise joining one end of the exhaust tube 10 to the groove 4 of the inner bulb 2 as shown in FIG. 1 or 2 can be eliminated. As a result, the production line can be simplified and the yield can be increased. It is not needed to join one end of the exhaust tube 10 to the groove 4 adjacent to either end thereof, but the exhaust tube 10 may be joined to the groove 4 at any suitable point in the vicinity of the open end 3 of the inner bulb 2. From the standpoint of the fabrication step, the latter is rather preferable.

When the zig-zag discharge groove 4 becomes too long, discharges occur through the spacings between the adjacent sections, causing the cross talk. However, according to the present invention, the spacings between the adjacent sections of the zig-zag discharge groove 4 can be positively sealed with glass frit in a simple manner so that the cross talk can be avoided. That is, before the open ends 3 are sealed together, glass frit is distributed into the spacings through which the cross talk occurs. Therefore, the spacings between the adjacent sections of the zig-zag discharge groove 4 can be completely sealed simultaneously when the open ends 3 are sealed together. It is preferable to distribute glass frit over the outer surface of the inner bulb 2 rather than the inner surface of the outer bulb 1 and it is more preferable to form grooves or recesses on the outer surface of the inner bulb 2 for receiving therein glass frit so that the step for distributing glass frit for sealing the spacings between the sections of the zig-zag discharge groove 4 is much facilitated.

Figure 4:
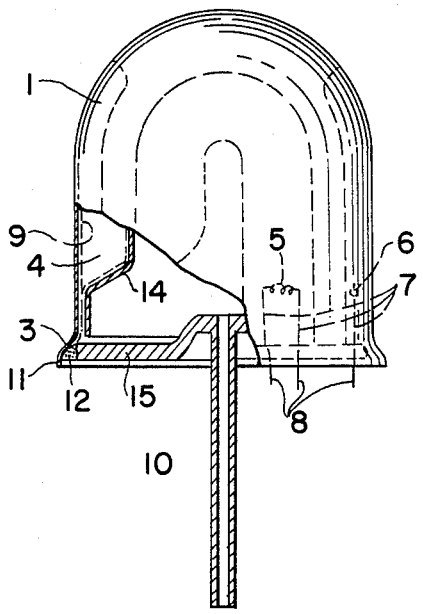

The present invention may be equally applied to a fluorescent lamp of the type shown in FIG. 4. Instead of the open ends 3 of the outer and inner bulbs 1 and 14 being sealed together with glass frit as with the first and second embodiments shown in FIGS. 2 and 3, after the inner bulb 2 has been fitted into the outer bulb 1 in predetermined relationship, the flared end 3 of the outer bulb 1 is sealed with a glass stem or a circular glass sealing disk 15 with the exhaust tube 10 extended downward from the center thereof. The inner surface of the flared end 3 of the outer bulb 1 and the peripheral surface of the glass stem or circular glass sealing disk 15 are gas-tightly joined with glass frit 12 in a manner substantially similar to that described above. Thereafter, the outer bulb 1 is evacuated through the exhaust tube 10 so that the inner bulb 2 is also evacuated.

In summary, in the embodiment of FIG. 4, glass frit 12 is filled into the annular space between the flared open end of the outer bulb 1 and the open end of the inner bulb 2 or the periphery of the glass stem or the circular glass sealing disk 15. In this case, it is important that glass frit 12 is uniformly distributed. To this end, the open end of the outer bulb 1 is flared radially outwardly or the open end of the inner bulb 2 is flared radially inwardly.

What is claimed is:

1. A fluorescent lamp of the type in which a lamp envelope comprises:

an outer bulb having generally a spherical or a partially spherical or a cylindrical configuration with a generally planar open end having a circumferential end portion, an inner bulb inserted into said outer bulb in predetermined nested relationship with said outer bulb, said inner bulb having a peripheral end portion adjacent the circumferential end portion of said outer bulb, and a stem or a circular sealing disk adapted to close the open end of said outer bulb;

either the inner surface of said outer bulb or the outer surface of said inner bulb being formed with a groove which defines a discharge groove between said outer and inner bulbs;

a phosphor formed at least over the wall surfaces of said groove on either the inner surface of the outer bulb or the outer surface of the inner bulb;

an electrode disposed at each end of said discharge groove; and a radiation emitting discharge gas consisting of mercury gas vapor and a rare gas or a rare gas mixture filled in said discharge groove, wherein the circumferential end portion of said outer bulb is flared radially outwardly so that glass frit can be filled in the annular space defined between the radially outwardly flared circumferential end portion of said outer bulb and the periphery of said stem or said circular sealing disk, whereby the radially outwardly flared circumferential end portion of said outer bulb and the periphery of said stem or said circular sealing disk can be gas-tightly sealed with said glass frit when the latter is heated and then solidified.

2. A process for fabricating a fluorescent lamp of the type in which a lamp envelope comprises:

an outer bulb having generally a spherical or partially spherical or a cylindrical configuration with a generally planar open end having a circumferential end portion, an inner bulb inserted into said outer bulb in predetermined nested relationship with said outer bulb, said inner bulb having a peripheral end portion adjacent the circumferential end portion of said outer bulb, and a stem or a circular sealing disk adapted to close the open end of said outer bulb; and a stem or a circular sealing disk adapted to close the open end of said outer bulb;

either the inner surface of said outer bulb or the outer surface of said inner bulb being formed with a groove which defines a discharge groove between said outer and inner bulbs;

a phosphor formed at least over the wall surface of said groove formed on either of the inner surface of the outer bulb or the outer surface of the inner bulb;

an electrode disposed at each end of said discharge groove;

comprising the steps of:

flaring radially outwardly the open end portion of said outer bulb, filling glass frit into the annular space defined between the radially outwardly flared open end portion of the outer bulb and the periphery of the stem or said circular sealing disk, and heating and then solidifying said glass frit, whereby the radially outwardly flared open end portion of said outer bulb and the periphery of said stem or said circular sealing disk can be gas-tightly sealed with said solidified glass frit.

* * * * *